United States Patent [19]

Biffle

[11] Patent Number: 4,500,094

[45] Date of Patent: Feb. 19, 1985

[54] HIGH PRESSURE ROTARY STRIPPER

[76] Inventor: Morris S. Biffle, 2609 Country Club Dr., Midland, Tex. 79701

[21] Appl. No.: 381,158

[22] Filed: May 24, 1982

[51] Int. Cl.[3] ..... F16J 15/56; F21B 33/03

[52] U.S. Cl. ..... 277/31; 251/1 R; 285/365

[58] Field of Search ..... 251/1 R; 277/31; 285/408, 406, 364, 365

[56] References Cited

U.S. PATENT DOCUMENTS

| | | | |
|---|---|---|---|
| 3,868,832 | 3/1975 | Biffle | 277/31 |
| 4,143,880 | 3/1979 | Bunting et al. | 277/31 |
| 4,154,448 | 5/1979 | Biffle | 277/31 |
| 4,157,186 | 6/1979 | Murray et al. | 277/31 |
| 4,208,056 | 6/1980 | Biffle | 277/31 |
| 4,398,599 | 8/1983 | Murray | 277/31 |

*Primary Examiner*—Alan Cohan
*Assistant Examiner*—Sheri Novack
*Attorney, Agent, or Firm*—Marcus L. Bates

[57] ABSTRACT

A rotating blowout preventor having only one moving part which cooperates with an upper bushing to provide resistance to upthrust and downthrust. The apparatus includes provisions for interaction to occur between the rubber of the stripper and the inside peripheral wall surface of the main body in a manner to provide a radial bearing member which resists lateral movement of a driving member received axially through the rotating stripper rubber. The stripper rubber rotates in low friction relationship respective to the remainder of the rotating blowout preventor. The apparatus includes a minimum of moving parts, and therefore is much easier to manufacture, maintain, and operate.

18 Claims, 6 Drawing Figures

HIGH PRESSURE ROTARY STRIPPER

BACKGROUND OF THE INVENTION

Rotating blowout preventers are known to those skilled in the drilling art, and are usually referred to as RBOPs; or, rotary stripper devices. There is hardly ever a borehole of any significance sunk into the ground without the employment of at least one high pressure rotary stripper device. The RBOP enables a driving member, such as a drill string, or the kelly of a drill string, to be slidably forced axially therethrough. The RBOP includes a stripper rubber assembly rotatably mounted respective to a main body so that the driving member and stripper rubber assembly rotate in low friction relationship respective to the remainder of the RBOP, and at the same time the drill string can be slidably positioned axially respective to the RBOP.

The stripper rubber assembly of the RBOP enables various different sizes of tubular goods to be forced downhole and retrieved from the high pressure interior of the borehole. However, from time to time, a larger or smaller elongated member must be connected within the drill string and placed within the borehole; and, for this reason it is advantageous to be able to readily remove the stripper rubber assembly from the main housing of from the RBOP so that a different size stripper rubber assembly can be employed therewith. Alternatively, in some instances, it is possible for the stripper rubber assembly to be removed from the main body, the elongated member passed downhole, or retrieved from the borehole, whereupon the stripper rubber assembly is again positioned within the main housing of the RBOP and the operation resumed.

RBOPs are usually quite complex, and may include more than a hundred parts. Therefore, the cost of the RBOP usually is directly proportional to its complexity. The RBOP is complex in design because it must be fabricated in such a manner to adequately resist the heavy forces resulting from upthrust and downthrust of the stripper rubber assembly, as well as the lateral forces imposed on the stripper rubber assembly.

In the past, accommodation of the above mentioned forces has been achieved by employing various different large and expensive ball bearings and tapered roller bearings which must be provided with an inside diameter of a size to accommodate the required stripper rubber assembly. The massive bearings require extensive design techniques in order to maintain them in proper operative condition, and in order to achieve a reasonable operational life expectancy. Needless to say, bearings of the required size and design are quite expensive.

My previous patents, U.S. Pat. Nos. 4,154,448 and 3,868,832, and U.S. Pat. No. 3,725,862, disclose an RBOP which can be advantageously employed as a high pressure rotary stripper.

The Murray patent, U.S. Pat. No. 4,157,186 and the Bunting, et al patent, U.S. Pat. No. 4,143,880, disclose an RBOP which can also be used in drilling some boreholes. The above mentioned RBOPs have performed satisfactorily during most drilling operations, however, the cost thereof is appreciable, and for this reason it would be desirable to have made available a reliable RBOP having a minimum number of parts, which is dependable in operation and which is uncomplicated in design. Such an RBOP is the subject of the present invention.

SUMMARY OF THE INVENTION

An RBOP having a main body, an axial passageway extending longitudinally through the main body through which a rotating drive member can be slidably extended. A rubber stripper assembly rotatably connected to the main body by an upper journal means and a lower journal means, with the stripper assembly being positioned in journaled relationship within the axial passageway by the upper and lower journal means.

The upper journal means sealingly resists upthrust and downthrust of the stripper assembly, while the lower journal means resists lateral forces imposed upon the stripper rubber assembly.

An axial passageway extends through the stripper assembly and is coextensive with the before mentioned axial passageway. A drive member is telescopingly received in sealed relationship through the rubber of the stripper assembly. An upper journal means is in the form of a bushing having an inwardly directed flange and forms an inwardly directed annular groove. The groove cooperates with complementary made parts of the stripper assembly. The bushing is fixed to said main body. The stripper rubber assembly includes an outwardly directed flange which forms an outwardly directed annular groove.

The bushing flange is received within the stripper groove and the stripper flange is received within the bushing groove, thereby forming said upper journaled means and providing low friction journal means for resisting upthrust and downthrust of the stripper assembly.

A medial, circumferentially extending, inner surface of the axial passageway formed within the main body received a medial, outer, circumferentially extending surface of the stripper assembly and thereby forms the lower journal means.

In one form of the invention the RBOP includes a lateral flow passageway located within said main body and at a location below the upper bearing surface, through which drilling fluid can flow while the stripper assembly is rotated by the driving member.

In another form of the invention, the bushing is bisected by a plane which extends along the axial centerline thereof, thereby forming bushing halves which may be moved laterally towards and away from one another in order to be mated and removed from the stripper assembly.

In another form of the invention, a removable mounting assembly forms an annular wear member. The member is affixed in a removable manner to the main body and forms a part thereof. The removable mounting assembly receives the bushing and stripper assembly therewithin, with the bushing being fixed respective to the wear member and to the main body, while the stripper assembly is rotatably positioned for rotation about its longitudinal axial centerline.

A clamp means is included by which the bushing and stripper assembly are removable affixed at the upper marginal end of the main body; and, in the instance of the embodiment which includes the annular wear member, the clamp assembly affixes the bushing to the upper marginal end thereof.

Accordingly, a primary object of the present invention is the provision of an RBOP having a bushing in lieu of bearings.

Another object of the present invention is the provision of an RBOP having a split bushing which provides a journal means for resisting upthrust and downthrust, and an interaction area formed between the stripper assembly and the interior of the main body for resisting lateral loads.

A further object of this invention is the provision of a high pressure rotary stripper having a unitary stripper rubber assembly rotatably received within a bushing means wherein the stripper assembly forms the only rotating part of the apparatus.

A still further object of this invention is the provision of an RBOP restricted to as few as four major components.

Another and still further object of this invention is the provision on an RBOP having but one moving part therewithin.

Another object of this invention is the provision of an RBOP having a unitary stripper assembly rotatably received in a removable manner within a split bushing which forms a journal means therewith.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
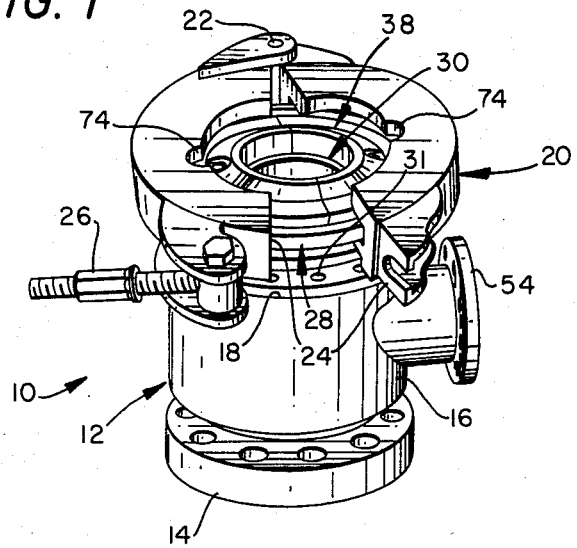
FIG. 1 is a perspective view which sets forth an RBOP made in accordance with the present invention.

In FIG. 1 of the drawings, there is disclosed a high pressure rotary stripper, or RBOP 10, made in accordance with the present invention. The RBOP includes a main body 12, having a lower flange 14 which provides a bolt circle by which the RBOP can be bolted to the top of a stack of preventors, or to the top of a cased borehole.

The apparatus 10 includes a cylindrical main housing 16 having an upper end 18. A split clamp 20 is hinged at 22 and includes the illustrated spaced confronting pivoted ends 24 which can be pivoted towards and away from one another. Fastener 26 cooperates with the hinged clamp device and maintains the clamp properly assembled respective to the remainder of the RBOP.

Numeral 28 generally indicates a removable mounting assembly which is affixed to the upper end 18 of the main body 16 by means of the illustrated bolt circle. When the removable mounting assembly is rigidly affixed to the main body by the illustrated circle of bolts, the mounting assembly is considered to be part of the main body.

A rubber stripper assembly 30 is positioned in underlying relationship respective to a split bushing or journal 38, the details of which will be more fully discussed later on.

Figure 2:
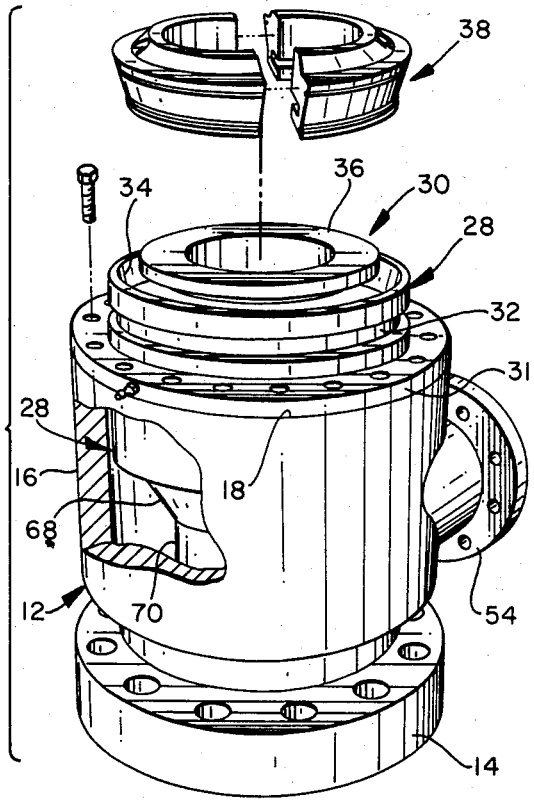
FIG. 2 is a perspective, partially disassembled view which illustrates additional details of the RBOP disclosed in the foregoing figure.

In FIG. 2 of the drawings, it will be noted that the clamp 20 has been removed, along with the before mentioned bushing 38 so as to better disclose the details of a rubber stripper assembly and the mounting assembly. Bolt flange 31 is an integral part of the removable mounting assembly and provides a circumferentially extending clamp receiving groove 32 at the upper marginal end thereof. An inner axial passageway 34 is formed on the interior of the removable mounting assembly. Upper flange member 36 provides an annular face which forms the upper extremity of the rubber stripper assembly. Split bronze journal 38 is received within the interior of the axial passageway 34. Note that the stripper assembly can be forced through the main body when the bushing is absent.

Figure 3:
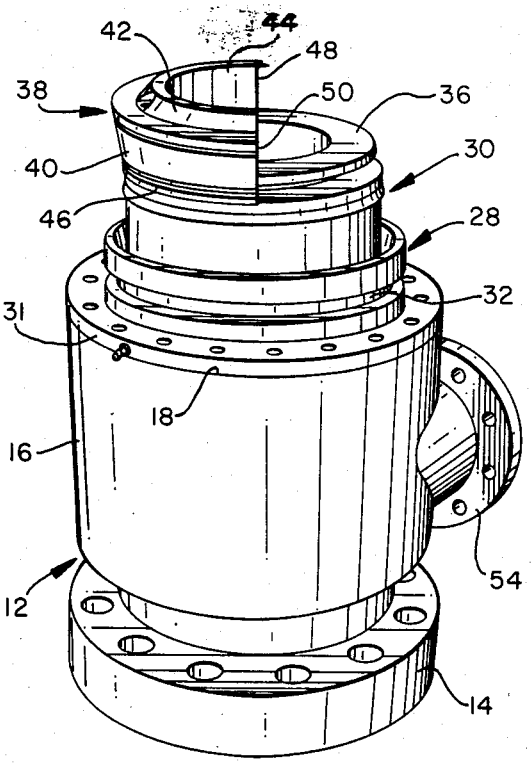
FIG. 3 is a partially disassembled perspective view of the RBOP disclosed in the foregoing figures.

In FIG. 3, there is disclosed additional details of the split bronze bushing. The bushing is of annular configuration and includes an outer contoured surface 40 which downwardly converges to form a truncated cone, with the truncation being received within the before mentioned axial passageway 34 of the removable mounting assembly. The bushing includes an upper contoured surface 42 which is made complementary with and coacts with the before mentioned clamp means to rigidly affix the bushing within the upper marginal end of the removable mounting assembly.

Innermost cylindrical surface 44 of the bushing is interrupted by the presence of an inwardly directed groove and flange, as will be more fully disclosed later on in this disclosure. Lower end 46 of the bushing bears against a coacting face formed on the stripper assembly, as will be better appreciated later on as this specification is more fully digested.

Each bushing half includes spaced vertical edges 48 and 50 which result from the bushing being bisected along a plane which extends through the axial centerline of the bushing. The confronting faces of the halves abuttingly engage one another to form a single bushing member. The clamp, bushing, rubber stripper assembly, removable mounting assembly, and main body each enjoy a common longitudinal axial centerline.

Figure 4:
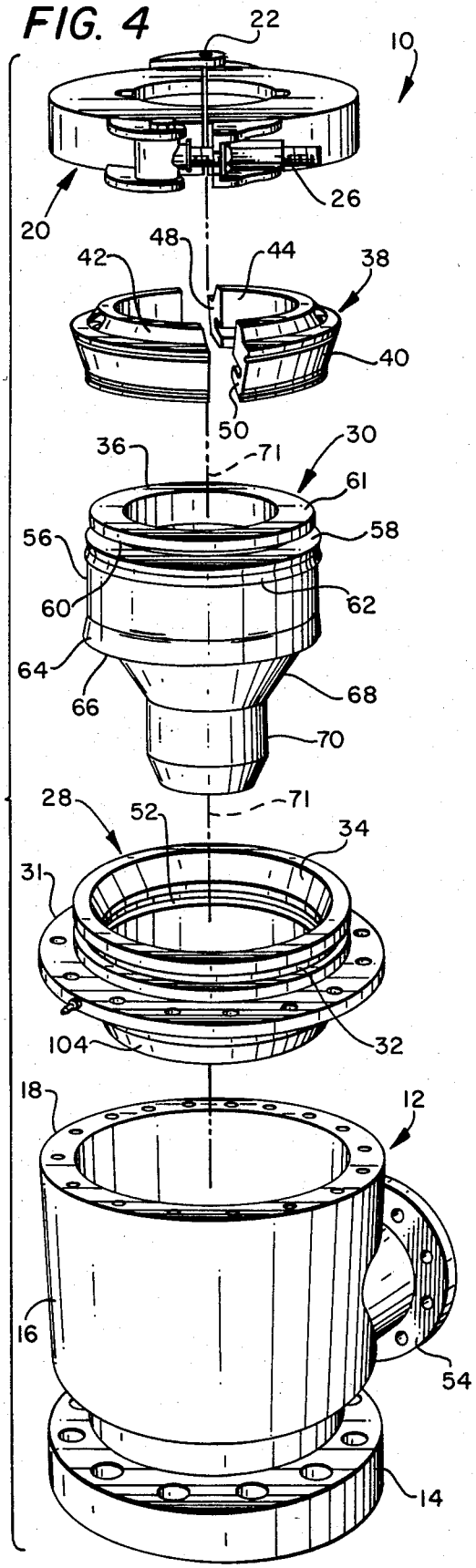
FIG. 4 is an exploded perspective view of the RBOP disclosed in the foregoing figures.

In FIG. 4 of the drawings, numeral 52 indicates an inwardly directed groove which is connected to a supply of lubricant (not shown) for lubricating the proper selected parts of the rubber stripper assembly. Lateral outlet 54 is provided with a bolt flange by which the outlet can be connected to a flow line leading to a mud pit, for example. The outlet is located below the lower journal means and is placed in communication with the annulus formed between the rubber stripper and the inside wall of the main body.

The rubber stripper assembly includes a synthetic rubber body 56 which terminates at upper face 58. The upper face preferably lies normal to the longitudinal axial centerline of the stripper assembly, and is in the form of an upper directed annular face. Lower annular face 60 of the upper flange member is spaced from face 58. The two confronting annular faces, along with upper flange face 60, form part of the upper journal means of the present invention.

Upper seal 62 is in the form of an outwardly directed rubber skirt which is made integral with the rubber body 56, and circumferentially extends about an upper marginal end of the rubber body. The rubber body outwardly diverges into a lower skirt member 64 which cooperates with the interior of the removable mounting assembly to form a radial bearing, the details of which will be more fully discussed later on in this disclosure.

Skirt 64 of the rubber terminates at 66 outwardly of the downwardly converging truncated conical part of the rubber. The rubber is then reduced in diameter into a cylindrical portion 70 which can be outwardly deformed for accommodating various different sizes of driving members through the axial passageway 71 thereof.

Figure 5:
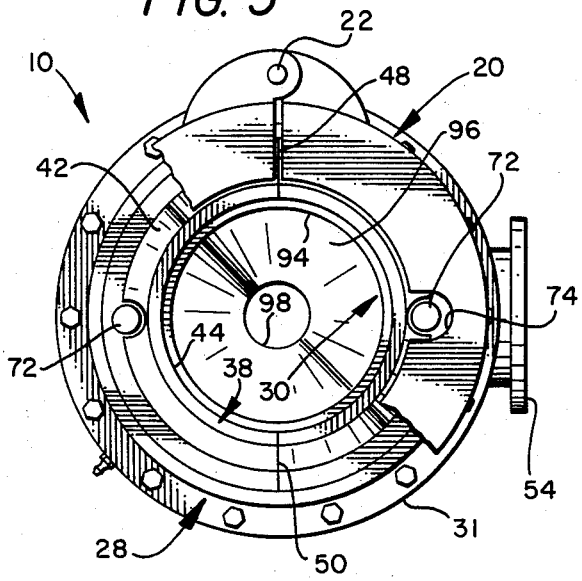
FIG. 5 is an enlarged, broken, top-plan view of an RBOP made in accordance with the present invention; and, FIG. 6 is an enlarged, fragmentary, longitudinal, cross-sectional view of an RBOP made in accordance with the present invention.

In FIG. 5, the split bushing is seen to be provided with opposed pins 72 which are received within notch 74 of the clamp means. The pins and notch provide a safe-guard against the rotation of the bushing within the clamp.

Figure 6:
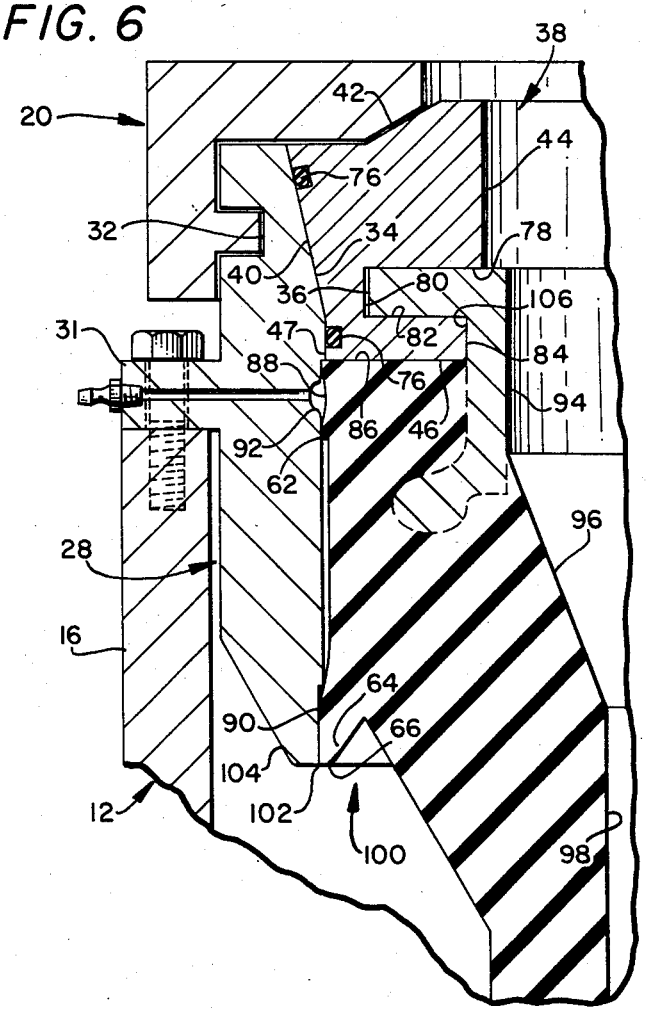

In FIG. 6, O-ring 76 provides a seal between the bushing and the upper mating surface of the removable mounting assembly. Numeral 78, 80, and 82 indicate wall surfaces which form an outwardly directed groove within the bushing. The groove also forms an outwardly directed flange 84 within the bronze bushing. The face 86 of the rubber body, which can be made of rubber or metal, bears against the face formed at the lower end 46 of the bushing. Of course, it is possible to assume the viewpoint that the flange 36 or 84 forms the grooves 80 or 106.

Numeral 88 indicates details of the before mentioned seal 62. Numeral 92 generally indicates an inwardly opening annular passageway through which grease can flow and lubricate all of the moving surfaces formed between the stripper assembly and the main body, or the inside surface of the mounting member and the bushing. Skirt 64 is deformed as it bears against the marginal inner surface 90 of the removable mounting assembly.

Large ID 94 of the rubber stripper assembly is reduced in diameter at converging inner wall 96, and assumes a small ID passageway at 98 for sealingly receiving the driving member in a slidable manner therethrough.

A debris barrier 100 is formed inwardly of lower edge portion 66. Interface 102 formed between members 104 and 66 prevent debris from entering the lateral bearing or the lower journal means.

In operation, the lower bolt flange is bolted onto a stack, that is, the other blowout preventer devices located at the top of a cased wellbore, before or during the borehole forming operation. The apparatus at this time is in the assembled configuration set forth in FIG. 1. A driving member, such as a kelly or other tubular members, is extended through the interior or axial passageway of the stripper rubber assembly by deforming the lower end 70 thereof as may be required. The driving member rotates, thereby importing rotational motion into the stripper rubber assembly, which is the only moving part of the disclosed invention.

The clamp can be removed from the upper end of the main body and the entire stripper rubber assembly along with the bushing lifted in an upward direction clear of the body. At this time, the bronze bushing can also be removed by moving the two halves laterally away from one another.

Should it become necessary to do so, the removable mounting assembly 28 can be unbolted from the main body and replaced or repaired as may be required.

With particular emphasis on FIG. 6, it should be noted that the bronze bushing includes an inwardly directed flange 84 having a lower face 46 and an upper face 82. The flange together with surface 78 forms an inwardly directed cavity having opposed faces 78 and 82, and an inner wall 80.

The upper marginal end of the stripper assembly includes a steel or metallic outwardly directed flange 36 made complementary respective to the groove formed by surfaces 78, 80, and 82 of the bronze bushing. Flange 36 is spaced from journal face 86 of the rubber, and forms groove 106 therewith.

Accordingly, the flange and groove of the bushing is made complementary respective to the flange and groove of the stripper assembly so that one is received within the other in low friction relationship. The faces 46, 86; 78 provide resistance against upthrust while the faces 82, 84, and 86 provide resistance against downthrust.

The seal at 64 and 90 which forms interface 102 constitutes a lower radial journal means which resists lateral movement of the rubber stripper assembly. The rubber body which is vulcanized to the steel flange therefore forms a journal means at 90 and 64. Lubricant is conducted into the annular passageway 92 and lubricates the coacting surfaces at 64, 62, 46, 86, 84, and 78–82.

In one embodiment of this invention, the apparatus preferably is limited to four parts, only one of which moves respective to the remaining parts. However, in order that the apparatus can rapidly be restored to new condition at the rig site, a mounting member is added to provide a total of five components. The apparatus is reliable, inexpensive to build, and simplified to enable a rig crew to assembly the parts in the proper sequence when it is necessary to do so.

As the pressure differential across the RBOP stripper rubber increases, the uphole thrust resistance increases in proportion thereto. Should the thrust member fail, the rubber body prevents the rubber components of the stripper assembly from being cold flowed uphole between or through the annulus formed between the rotating member of the RBOP. The present RBOP can withstand substantially more static pressure than the prior art RBOP's and therefore this increases the safety of the personnel on the rig.

The present invention provides a significant advantage over other stripper operations because the rubber rotates within its enclosure and in the head itself, rather than the pipe rotating in the rubber bore. The ID of the rubber can be sized to accept various different OD strings, because the present invention enables the rubber of the stripper assembly to be bored to several different ID's in order to accept various different diameters of driving members therethrough. This greatly reduces the number of different stripper assemblies that otherwise would have to be manufactured and stored in order to achieve the same results.

I claim:

1. In an RBOP 10 having a relatively stationary main body 12 adapted to be affixed to the upper end of a cased borehole, a central passageway 71 formed through the body, so that a rotatable driving member can extend through the passageway and into a borehole; the improvement comprising:

a rubber stripper assembly 30 having a flange 36 at the upper end thereof, and a stripper rubber 56 at the lower end thereof, said stripper assembly is rotatable respective to said main body, said flange has opposed faces 78, 82 and is spaced from an upwardly directed annular surface 86 to form an outwardly opening groove 86, 106, 82; a medial circumferentially extending sidewall 62 of said stripper rubber is spaced below said annular surface 86; an axial passageway 96, 98 formed through said stripper assembly for slidably receiving a driving member 71 therethrough;

a bushing 38 having an annular groove 78, 80, 82 within which said flange 36 is rotatably received in low friction relationship therewith;

said bushing 38 has a lower downwardly directed annular face 46 against which said annular surface 86 of said stripper assembly bears when the stripper is thrust uphole;

means mounting said bushing 44 in fixed relationship respective to said main body, said central passageway 62, 90 of said main body includes a bearing surface against which said sidewall 62 and 90 of said rubber bears and thereby forms a radial bearing.

2. The improvement of claim 1 wherein said RBOP includes a lateral flow passageway located within said main body and at a location below said radial bearing through which drilling fluid can flow while said stripper assembly is rotated by the driving member.

3. The improvement of claim 1 wherein said bushing is bisected by a plane which extends along the axial centerline thereof, thereby forming bushing halves which may be moved laterally and mated with said stripper assembly.

4. The improvement of claim 1 and further including an annular mounting member affixed in a removable manner to said main body for receiving said bushing and said stripper assembly therewithin, the mounting member includes an interior wall surface against which said sidewall of said rubber bears.

5. The improvement of claim 1 wherein an annular wear member is affixed in a removable manner to said main body for receiving said bushing and said stripper assembly therewithin;

and a clamp means by which said bushing and stripper assembly are removably affixed to the upper marginal end of said main body.

6. The improvement of claim 1 wherein said bushing is bisected by a plane which extends along the axial centerline thereof, thereby forming bushing halves which may be moved laterally and mated with said stripper assembly;

and an annular wear member affixed in a removable manner to said main body for receiving said bushing and said stripper assembly therewithin.

7. The improvement of claim 1 wherein said RBOP includes a lateral flow passageway located within said main body and at a location below said bearing surface through which drilling fluid can flow while said stripper assembly is rotated by the driving member; a mount member removably affixed to and forming the upper end of said main body;

and a clamp means by which said bushing and stripper assembly are removably affixed to the upper marginal end of said mount member.

8. The improvement of claim 1 wherein a circumferentially extending clamp means removably mounts said bushing to the upper marginal end of said main body;

and an annular wear member affixed in a removable manner to said main body for receiving said bushing and said stripper assembly therewithin;

said annular member includes an outer annular groove which receives an inwardly directed lip of the clamp therewithin;

said bushing includes an inclined seating surface which is received in close tolerance relationship within said annular wear member;

and means for lubricating the coacting area between said stripper assembly and the interior of said wear member.

9. The improvement of claim 8 wherein said RBOP includes a lateral flow passageway located within said main body and at a location below said bearing surface through which drilling fluid can flow while said stripper assembly is rotated by the driving member.

10. The improvement of claim 9 wherein said bushing is bisected by a plane which extends along the axial centerline thereof, thereby forming bushing halves which may be moved laterally and mated with said stripper assembly.

11. A RBOP having a stationary main body, an axial passageway extending through said main body through which a rotating drive member can extend, a rubber stripper assembly, an upper journal means, a lower journal means, said stripper assembly is positioned in journaled relationship within said axial passageway by said upper and said lower journal means whereby said stripper assembly rotates respective to said main body, an axial passageway extending through said rubber stripper assembly for nonrotatively receiving a drive member in sealed relationship therethrough so that the stripper assembly rotates about the longitudinal axial centerline thereof; the improvement comprising:

said upper journal means is a bushing having an inwardly directed flange which forms an inwardly directed annulus, said bushing is fixed to said main body in axial alignment therewith;

said rubber stripper assembly includes an outwardly directed flange which forms an outwardly directed annulus; the bushing flange is received within the stripper annulus, and the stripper flange is received within the bushing annulus, thereby forming said upper journal means, and providing low friction journal means for resisting upthrust and downthrust of said stripper assembly;

a medial inner circumferentially extending surface of said axial passageway of said main body receives a medial outer circumferentially extending surface of said stripper assembly thereagainst and thereby forms said lower journal means.

12. The improvement of claim 11 wherein said RBOP includes a lateral flow passageway located through a sidewall of said main body and at a location below said bearing surfaces through which drilling fluid can flow while said stripper assembly is rotated by a driving member.

13. The improvement of claim 11 wherein said bushing is bisected by a plane which extends along the axial centerline thereof, thereby forming bushing halves which may be moved laterally and mated with said stripper assembly.

14. The improvement of claim 11 and further including an annular wear member affixed in a removable manner to said main body for receiving said bushing and said stripper assembly therewithin.

15. The improvement of claim 11 wherein an annular wear member affixed in a removable manner to said main body for receiving said bushing and said stripper assembly therewithin;

and a clamp means by which said bushing and stripper member are removably affixed to the upper marginal end of said main body.

16. The improvement of claim 11 wherein said bushing is bisected by a plane which extends along the axial centerline thereof, thereby forming bushing halves which may be moved laterally and mated with said stripper assembly;

and an annular wear member affixed in a removable manner to said main body for receiving said bushing and said stripper assembly therewithin.

17. The improvement of claim 11 wherein said RBOP includes a lateral flow passageway located within said main body and at a location below said bearing surface through which drilling fluid can flow while said stripper assembly is rotated by the driving member;

and a clamp means by which said bushing and stripper assembly are removably affixed to the upper marginal end of said main body.

18. The improvement of claim 11 wherein a mount member forms an annular wear member; said mount member is affixed in a removable manner to said main body for receiving said bushing and said stripper assembly therewithin;

a circumferentially extending clamp means removably mounts said bushing to the upper marginal end of said mount member;

an outer annular groove is formed within said mount member and receives an inwardly directed lip of the clamp therewithin;

said bushing includes an inclined seating surface which is received in close tolerance relationship within said mount member;

and means for lubricating the coacting area between said stripper assembly and the interior of said wear member.

* * * * *